US005538241A

United States Patent [19]

Auerbach et al.

[11] Patent Number: 5,538,241

[45] Date of Patent: Jul. 23, 1996

[54] IN-LINE SHEET TRANSPORT WITH ENABLING AND DISABLING MEANS

[75] Inventors: David R. Auerbach, West Redding; Kenneth W. Lowell, Bristol, both of Conn.

[73] Assignee: Pitney Bowes, Stamford, Conn.

[21] Appl. No.: 359,771

[22] Filed: Dec. 20, 1994

[51] Int. Cl.[6] ..... B65H 5/00

[52] U.S. Cl. ..... 271/274; 271/273; 271/225

[58] Field of Search ..... 271/225, 226, 271/264, 273, 274, 184, 278, 272; 198/457, 836.2

[56] References Cited

U.S. PATENT DOCUMENTS 5,188,355 2/1993 Lowell et al. ..... 198/457
5,318,285 6/1994 Edwards et al. ..... 271/184

FOREIGN PATENT DOCUMENTS 4-3211140 9/1991 Japan ..... 271/273

*Primary Examiner*—H. Grant Skaggs
*Attorney, Agent, or Firm*—Charles R. Malandra, Jr.; Melvin J. Scolnick

[57] ABSTRACT

Apparatus for transporting documents along a paper path includes a plurality of in-line idler rollers biased against a corresponding plurality of in-line driven rollers. The in-line idler rollers are mounted to an in-line transport assembly that is cantilevered over a paper path on a deck. The in-line transport assembly includes a plurality of idler shafts rigidly and transversely suspended over the paper path between two end plates. The in-line idler rollers are rotatably mounted to arm members that are secured to the idler shafts in pairs above the deck. Guide structure is located at the downstream end of the in-line transport for preventing the documents from skewing and lifting away from the deck as the documents are transported. The transport also includes structure for enabling and disabling the in-line transport.

7 Claims, 5 Drawing Sheets

12
20
22
24
26
28
30
36
52
56
60
62
80
88
89
90
94
96
98
100
104
106
108
110
111
114
118
130
131
132
134

IN-LINE SHEET TRANSPORT WITH ENABLING AND DISABLING MEANS

FIELD OF THE INVENTION

The present invention relates generally to apparatus for transporting documents, and more particularly, to apparatus for transporting documents in an inserting machine.

RELATED APPLICATIONS

The present application is related to U.S. patent applications Ser. Nos. 08/359,663 and 08/359,687, filed concurrently herewith, and assigned to the assignee of the present invention, and to U.S. application Ser. No. 08/173,040, filed Dec. 27, 1993, now U.S. Pat. No. 5,413,326, and assigned to the assignee of the present invention.

BACKGROUND OF THE INVENTION

Devices are known which turn flat articles such as letter envelopes, within a plane. Such devices have been used in inserting machines when envelopes are discharged from an insert station at which the envelope is stuffed with enclosures and the envelopes must be turned and reoriented before being conveyed for further processing by a downstream device such as a franking machine. Generally, such turner devices have the disadvantage of having to be an integral part of the inserting machine. Examples of devices which turn flat articles in inserting machines are shown in U.S. Pat. No. 4,726,461 issued Feb. 23, 1988 to J. Pokrinchak and U.S. Pat. No. 4,928,807 issued May 29, 1990 to D. Auerbach, both of which patents are assigned to the assignee of the present invention.

It is known to change the direction of travel for flat articles without changing the orientation of the articles, i.e., without rotating or turning the articles, referred to herein as a "right angle transfer". One example of a right angle transfer is a device that provides a one stage right angle change in direction in which the articles must be stopped in one direction before being conveyed in the right angled direction. Such a device is described in U.S. Pat. No. 4,909,374 issued Mar. 20, 1990 to M. Skrypalle and assigned to the assignee of the present invention.

Other right angle transfers are known to include two or more stages one of which includes deflection rollers that change the direction of travel by forty-five degrees (45°) or less at each stage. An example of such an apparatus in a sorting machine is disclosed in U.S. Pat. No. 4,527,792 issued Jul. 9, 1985 to G. Burkhardt. The Burkhardt apparatus has several limitations which prevent it from being usable in an inserting machine. The apparatus is limited to changing direction of travel from a path parallel to a long edge of the mailpiece to a path of travel parallel to the short edge thereof. Furthermore, for all sized mailpieces, the Burkhardt apparatus requires a side-justified line of travel along the first direction of travel so that the deflection rollers can engage the article at the right moment to achieve an accurate change in direction. Typically, in an inserting machine the center line of travel of the mailpiece is fixed with the side guides being adjustable for handling various sized mailpieces.

Several versions of right angle transfers are known for use in inserting machines. In U.S. Pat. No. 5,180,154, issued on Jan. 19, 1993 to S. Malick and assigned to the assignee of the present invention, right angle transfer apparatus for conveying flat articles in an inserting machine is disclosed.

The apparatus includes a deck having an input end for receiving an article from a first direction and a plurality of angled roller pairs for conveying the article over the deck in the second direction. The angled roller pairs engage a leading edge of the article only after the article has been released by a conveying means in the first direction. A registration wall, which extends at a right angle to the first direction, is positioned downstream from the angled roller pairs adjacent an output end of the deck. The leading edge of the article is driven against the registration wall as the article is released by the angled roller pairs. A third direction conveying means takes control of the article as soon as the article is against said registration wall.

Variations of the Malick '154 right angle transfer apparatus are also known. U.S. Pat. No. 5,180,159, issued on Jan. 19, 1993 to S. Malick and assigned to the assignee of the present invention, provides an adjustable right angle transfer apparatus for conveying flat articles in one of two directions. This apparatus is similar to the Malick '154 apparatus but the angled roller pairs for conveying in a second direction are mounted on a circular deck that can be rotated to position the rollers for conveying forty-five degrees to the left or to the right. U.S. Pat. No. 5,188,355, issued on Feb. 23, 1993 to K. Lowell et al. and assigned to the assignee of the present invention, provides a right angle transfer apparatus for sheets of paper. This apparatus is also similar to Malick '154 except for changes found to be necessary in moving individual sheets through the right angle transfer at high speed. For example, the registration wall was eliminated and spring guides were added to prevent the sheets from lifting off the deck.

The foregoing apparatus are configured for handling documents of a particular size, such as envelopes or sheets of paper. Although the foregoing apparatus work well for handling single size documents, they lack adjustment capability needed for handling multiple size documents. Typically, the foregoing apparatus requires the addition or removal of rollers angled at 45° when the apparatus is used to handle larger or smaller documents respectively. Furthermore, the foregoing apparatus do not include a path for straight through processing in the third direction.

SUMMARY OF THE INVENTION

The present invention provides an in-line transport that can be used adjacent a transport moving documents from another direction toward the in-line transport. The in-line transport is disengaged when documents are being transported from the other direction.

In accordance with the present invention, apparatus for transporting documents along a paper path includes a plurality of in-line idler rollers biased against a corresponding plurality of in-line driven rollers. The in-line idler rollers are mounted to an in-line transport assembly that is cantilevered over a paper path on a deck. The in-line transport assembly includes a plurality of idler shafts rigidly and transversely suspended over the paper path between two end plates. The in-line idler rollers are rotatably mounted to arm members that are secured to the idler shafts in pairs above the deck. Guide structure is located at the downstream end of the in-line transport for preventing the documents from skewing and lifting away from the deck as the documents are transported. The transport also includes structure for enabling and disabling the in-line transport.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figures 1, 4:
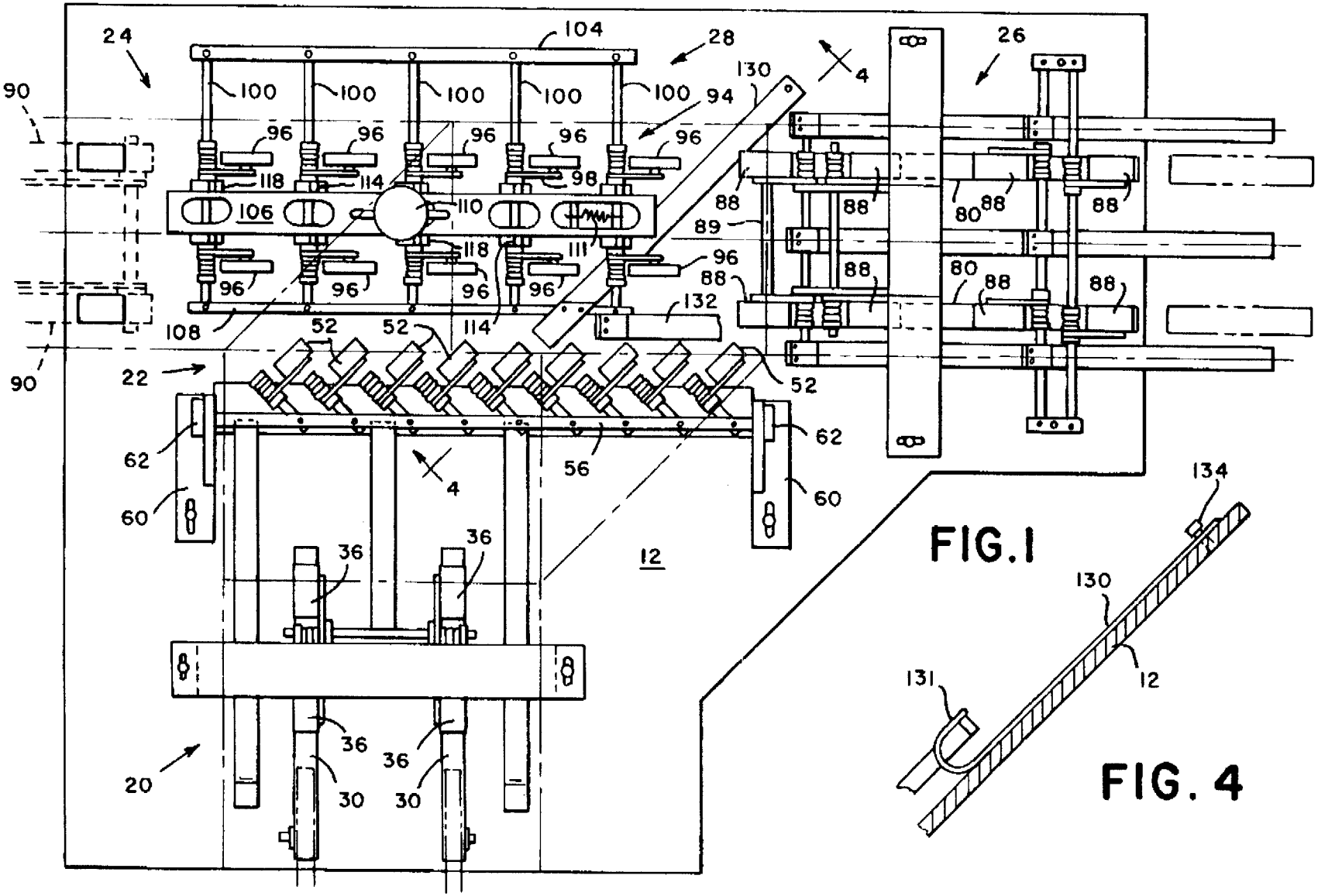
FIG. 1 is a plan view of an apparatus for changing the direction motion of documents in accordance with the present invention.
FIG. 4 is a side view of a diagonal guide strap for the apparatus of FIG. 1.
Figure 2:
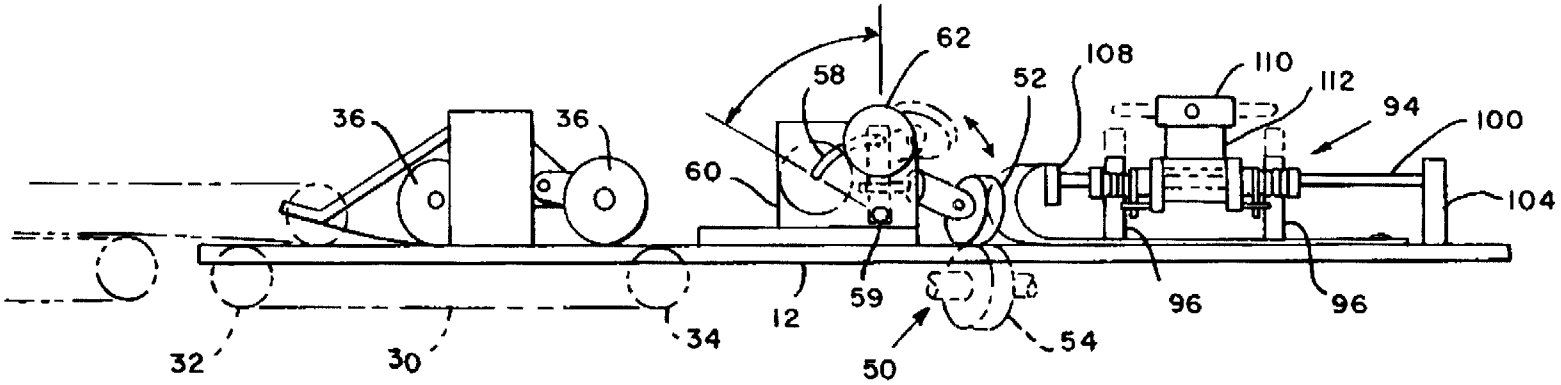
FIG. 2 is a side view of an input transport of the apparatus of FIG. 1 taken along the lines 2—2.
Figure 3:
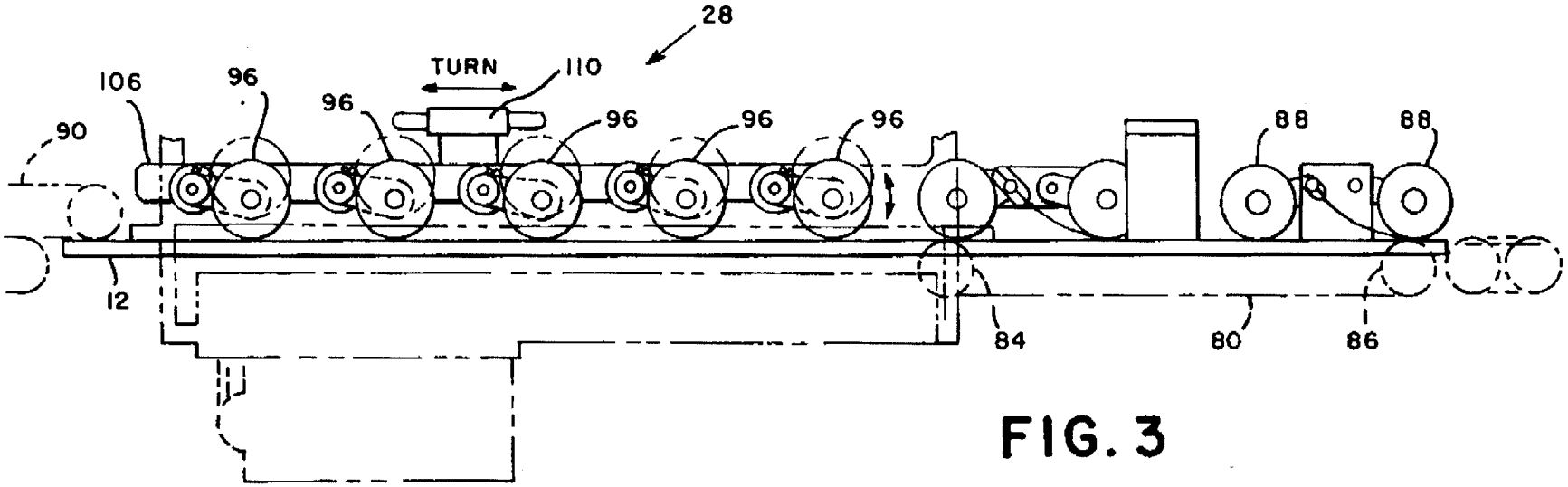
FIG. 3 is an end view of the apparatus of FIG. 1 taken along the lines 3—3.

In describing the preferred embodiment of the present invention, reference is made to the drawings, wherein there is seen in FIGS. 1–3 an apparatus, generally designated 10, for changing the direction of motion of documents. Apparatus 10 includes a deck 12, a first input section, generally designated 20, a transfer section, generally designated 22, a second input section, generally designated 24, an in-line transport section, generally designated 28 and an output section, generally designated 26. In accordance with the present invention, apparatus 10 transports individual documents (not shown) having a landscape orientation at first input section 20 through transfer section 22 and outputs the document at output section 26 with the document in a portrait orientation. (It will be understood that apparatus 10 could also transport documents from portrait to landscape). Apparatus 10 can also transport documents in-line from second input section 24 straight through to output section 26.

First input section 20 includes a pair of conventional endless, flat transport belts 30 each of which has an upper reach that extends through a slot in deck 12. Each belt 30 travels around a pair of pulleys 32 and 34, one of which is driven by a conventional belt drive. A normal force is applied to each belt 30 by a pair of biased, idler rollers 36.

Transfer section 22 includes a plurality of roller pairs, generally designated 50. Each roller pair 50 includes an upper, biased idler roller 52 and corresponding lower driven roller 54 that are angled at forty-five degrees to first input belts 30. Roller pairs 50 are positioned such that a line extending through the nip of each roller pair 50 is perpendicular to first input belts 30. Lower rollers 54 of roller pairs 50 are driven by a separate conventional roller drive (not shown). Transfer section 22 seizes the entire leading edge of a document transported by first section 20 and takes control of the document from first input section 20 to initiate the right angle transfer of the document.

Upper rollers 52 are mounted to plate 56 which extends at each end through slots 58 in mounting brackets 60 that are mounted on deck 12. Slots 58 are in the shape of an arc having an origin at 59. Plate 56 is threaded at each end and a lock nut 62 having a corresponding threaded aperture is mounted thereto. The plate 56 is pivoted in mounting brackets 60 about the origin 59 of the arc of slots 58. The normal operating position for idler rollers 52 is down to provide a normal force against driven rollers 54. When documents are being transported from second input section 24 to output section 26, upper rollers 52 must be retracted so that they do not interfere with such straight through conveyance. Idler rollers 52 are retracted by loosening lock nuts 62 and moving plate 56 to a position in slots 58 causing upper rollers 52 to be raised away from lower rollers 54 so as not to interfere with documents conveyed from second input section 24.

Output section 26 includes a pair of lower, endless belts 80 traveling in a direction orthogonal to the travel of input belts 30. Belts 80 are downstream of in-line transport 28. Belts 80 travel around pulleys 84 and 86, one of which is driven by a conventional belt drive. Pulleys 84 and 86 are rotatably mounted to the underside of deck 12 in a conventional manner. The upper reach of belts 80 extend through slots in deck 12. Biased idler rollers 88 are suspended above belts 80 in a conventional manner to provide a normal force on belts 80 to assist belts 80 in moving the documents downstream for further processing.

Second input section 24 includes an upper, driven belt 90 that is part of an upstream input module (not shown). Belt 90 extends over the entrance portion of deck 12 at second input section 24.

In-line transport 28 is located between second input section 24 and output section 26. In-line transport 28 includes a plurality of conventional idler roller assemblies 94 and corresponding driven rollers 92 which are located below deck 12 and extend in part through slots in deck 12. Each idler roller assembly 94 includes an idler roller 96, which is rotatably mounted to an arm 98 which in turn is pivotally mounted to a shaft 100 and spring loaded towards driven rollers 92 to provide a normal force against rollers 92. Shafts 100 are mounted at one end to an end plate 104 which is out of the document path, through slots 126 in a center plate 106 and at the other end to end plate 108. End plate 104 is rigidly mounted to deck 12 to support in-line transport 28 which is cantilevered over the document path when idler roller assemblies 94 are in a raised position. End plate 108 and center plate 106 are always suspended above deck 12 even when idler roller assemblies 94 are in a lower operational position.

In-line transport 28 includes structure for simultaneously raising all idler rollers 96 such that they do not interfere with a right angle transfer of documents transported from first input section 20. Each arm 98 includes a pin 114 which fits into a groove 116 in an adjacent bushing member 118 that is mounted to a side member 120 of center plate 106. An in-line roller assembly knob 110 is rotatably mounted through an aperture in center plate 106. Knob 110 has an upper cylindrically shaped member 112 that is larger than the aperture in center plate 106 for supporting knob 110 on center plate 110. The lower member of knob 110 that extends below the top member of center plate 106 has alternating eccentric and flat sections 117 and 119, respectively, which are 90° apart and serve as detents against an adjacent one of shafts 100. Flat sections 117 and 119 are urged against the shaft 100 by a spring 111 that is connected at one end to another shaft 100 and at the other end to center plate 106.

Figure 5:
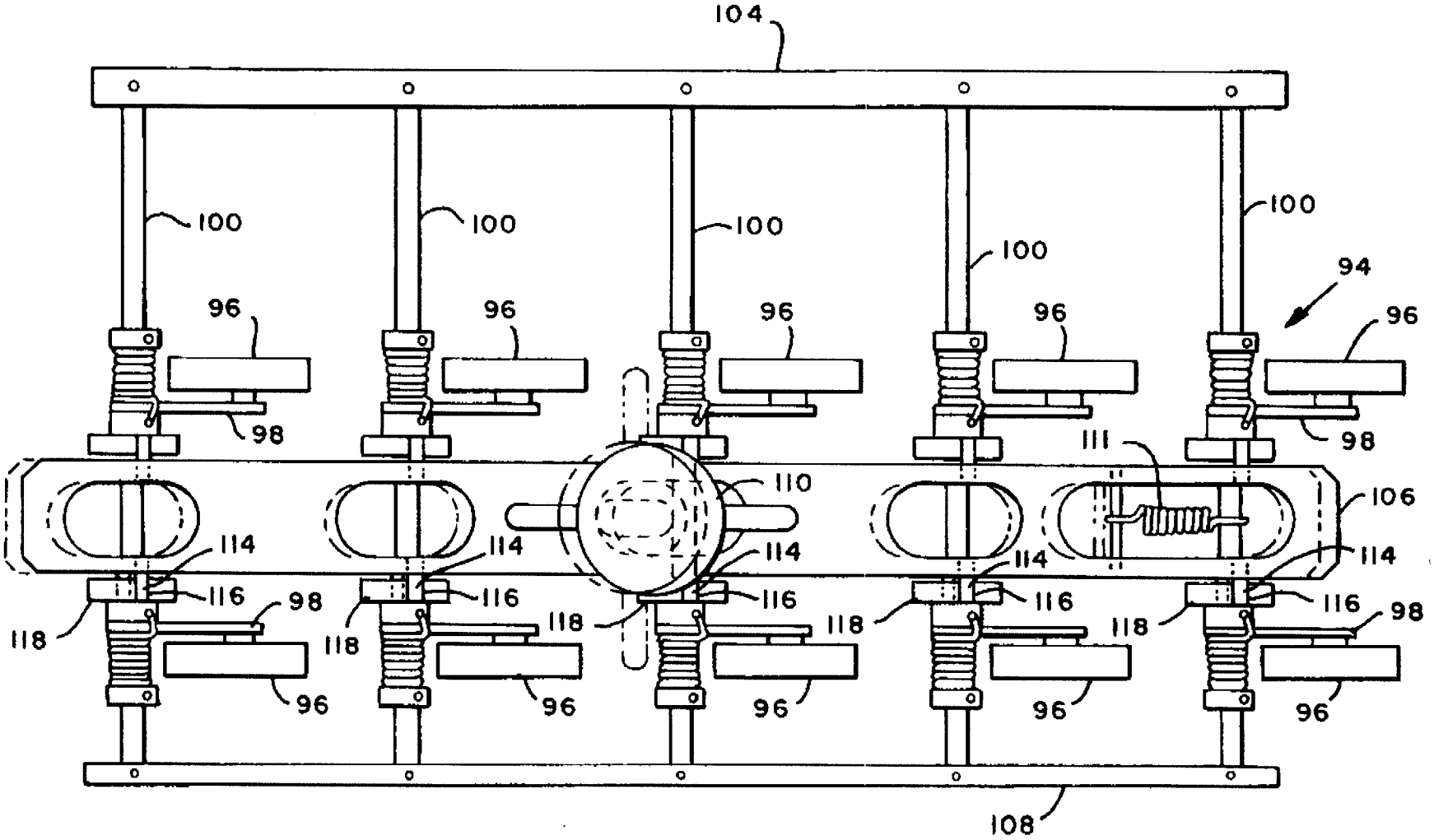
FIG. 5 is a plan view of an in-line transport of the apparatus of FIG. 1.
Figure 6:
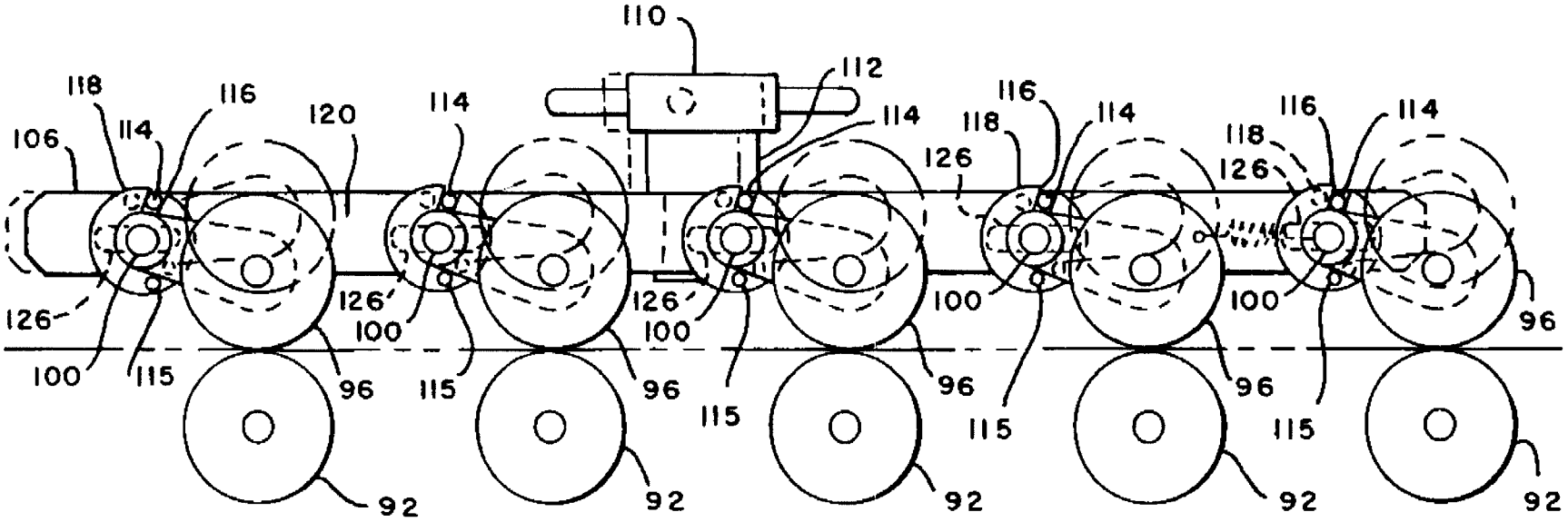
FIG. 6 is a side view of the in-line transport of FIG. 5.
Figure 7:
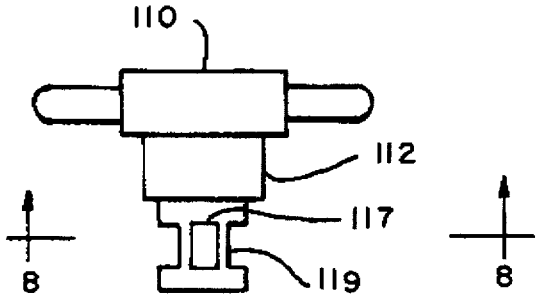
FIG. 7 is a side view of a knob member with detents of the in-line transport of FIG. 5.
Figure 8:
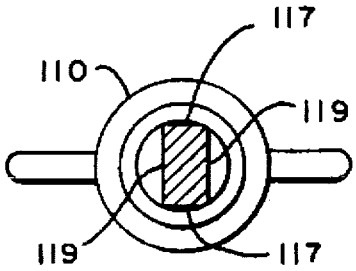
FIG. 8 is a bottom view of the knob member of FIG. 7.
Figure 9:
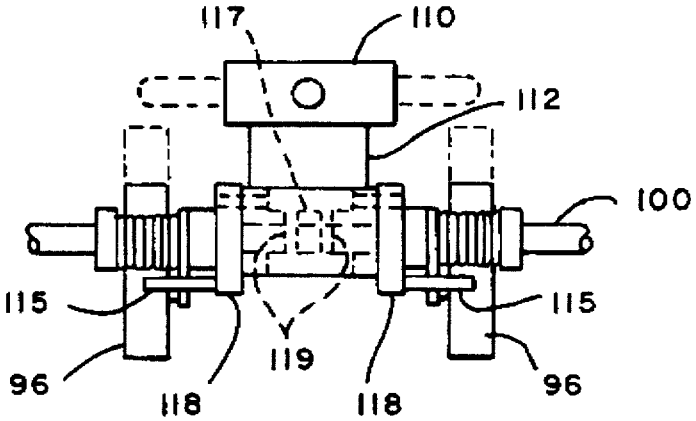
FIG. 9 is an end view of the in-line transport of FIG. 5.

Referring now to FIGS. 3, 5 and 6, each 90° rotation of knob 110 causes center plate 106 to move horizontally between two positions. When passing material straight through from second input section 24 to output section 26, rollers 96 are down to provide a normal force against driven rollers 92. A 90° rotation of knob 110 causes center plate 106 to move horizontally to the position shown in phantom in FIGS. 3, 5 and 6. Since bushing members 118 are allowed to rotate on the stationary shafts 110, a force against slot 116 from pins 114, which are fixed to center plate 106, causes the bushing members 118 to rotate in respect to the shafts 110 that are holding the roller assemblies 94. A lifting pin 115 is fixed to each of the bushing members 118 and is positioned under an adjacent roller arm 98. As bushing members 118 rotate, lifting pins 115 come into contact with the bottom of roller arms 94 lifting rollers 96 off the deck to provide clearance for the documents to pass under when the documents are being transported from first input section 20 to output section 26. A further 90° rotation of knob 110 returns center plate 106 and rollers 96 to their respective normal operational position.

Documents transported by in-line transport 28 or by transfer section 22 pass underneath guide strap 130 which is a tempered spring strip that extends at a 45° angle to the document paths at first and second input sections 20 and 24. Guide strap 130 is preformed to the shape shown in FIG. 4 with one end of guide strap 130 formed into a loop 131. The looped end 131 is attached to end plate 108 at one side of the in-line document path. Guide strap 130 extends diagonally across to the opposite side of the in-line document path output section 26 and at a 45° angle to the document path. The other end of guide strap 130 is attached to the deck with a shoulder screw 134 (FIG. 4) which allows guide strap 130 to move vertically to accommodate documents passing beneath it, while preventing any horizontal movement of guide strap 130. It has been found that such vertical movement is a critical part of guide strap 130 functioning as a document guide in both directions, and in particular during the right angle transfer from landscape to portrait. Guide strap 130 is position to control the center of gravity the document as the document changes direction at high speeds. Guide strap 130 has somewhat of friction quality to it which absorbs the energy of the change of direction of the document. It has also been found that the physical position of guide strap 130 diagonally across the document as it changes direction at high speeds prevents the document from skewing or fishtailing.

In the preferred embodiment a gap of approximately 0.060 inches is maintained by the preformed guide strap 130 and the head of shoulder screw 134. The lead edge of documents from either the first input section 20 or the second input section 24 is first guided underneath guide strap 130 by the curve end 131 of guide strap 130. It will be understood that an alternate method for maintaining the gap is by use of a thin washer (not shown) that is positioned between the pinned end of guide strap 130 and deck 12 to provide the necessary clearance for documents to pass therebetween.

A second, shorter guide strap 132 is mounted at one end to end plate 108 and the other end rests on deck 12. Guide strap 132 holds the lead edge of the document down as it enters the nip of roller 88 and belt 80. Thus, both entry nips into output section 26 have guide straps that control the lead edge of the documents transported thereto. Guide straps 130 and 132 provide the benefits of ease of assembly (with little or no adjustments necessary) and easy jam clearance. Furthermore, the present invention provides a quick and easy change from right angle transfer to in-line transporting and back again. Such changes are easily performed by an operator.

In accordance with the present invention, apparatus 10 can be configured for right angle transfers from first input section 20 or for in-line transport from second input section 24. For right angle transfers apparatus 10 is configured with in-line, idler roller assemblies 94 in a raised position. Knob 110 is rotated 90° to lift all idler rollers 96 off the deck so that they are not engaging drive rollers 92. Transfer section 22 is configured with rollers 52 locked in a down position so that they are engaging drive rollers 54. In this configuration, a document enters first input section 20 in a landscape orientation. The lead edge of the document is seized by transfer section 22 as the lead edge enters the nip of diagonal rollers 52 and 54. Transfer section 22 transports the document at a 45° angle toward output section 26 without changing the orientation of the document. Guide straps 130 and 132 guide the lead edge of the document into the nip of rollers 88 and belts 80. The document is released by transfer section 22 at the moment the document is in line with the output path and the lead edge of the document engages the nip of rollers 88 and belts 80. Rollers 88 are attached to each other by a shaft 89 so that no rotational movement between rollers 88 can occur. This arrangement insures that the orientation of the documents is maintained during the directional change from first input section 20 to output section 26. The document that was originally transported in landscape orientation by first input section 20 is now being transported by output section 26 in portrait orientation.

For in-line transporting of documents, e.g., portrait to portrait, from second input section 24 to output section 26 rollers 52 of transfer section 22 are pivoted away from driven rollers 54. Knob 110 is rotated 90° to lower roller assemblies 94 to an operational position. No further adjustments are needed to transport in-line from second input section 24. Again guide straps 130 and 132 guide the lead edge of the document into the nip of rollers 88 and belts 80.

When documents are being transported from first input section 20 it is critical that idler rollers 96 do not interfere with the right angle transporting of the documents. Thus in accordance with the present invention, all idler roller 96 are raised away from contact with driven rollers 92. In accordance with the present invention idler roller assemblies 94 are raised away from driven rollers 92 by rotating an in-line roller assembly knob 110 ninety degrees.

When documents are being transported through the right angle transfer from first input section 20, roller pairs 50 are locked in a down position against driven rollers 56 and idler roller assemblies 94 are locked in a raised position.

In accordance with the present invention the belts 30, rollers 92 and belts 80 are driven such that the documents are transported through apparatus 10 at a constant speed.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. Apparatus for transporting documents along a paper path, comprising:

a deck;

a plurality of in-line idler rollers biased against a corresponding plurality of in-line driven rollers, said in-line idler rollers being mounted to an in-line transport assembly that is cantilevered over a paper path on said deck, said in-line transport assembly including a plurality of idler shafts rigidly and transversely suspended over a third direction paper path between two end plates, said in-line idler rollers being rotatably mounted to arm members that are secured to said idler shafts in pairs above said deck on said idler shafts;

guide means located at the downstream end of said in-line transport for preventing the documents from skewing and lifting away from said deck as the documents are transported; and means for enabling and disabling said in-line transport and wherein said in-line transport further includes a center plate section through which said idler shafts extend through slots in side members thereof, each of said arms being fixedly coupled to said center plate adjacent one of said slots.

2. The apparatus of claim 1 wherein said enabling and disabling means include means for moving said idler transfer rollers away from said driven transfer rollers.

3. The apparatus of claim 2 wherein said disabling means include means for simultaneously raising all of said in-line idler rollers away from said in-line driven rollers.

4. The apparatus of claim 1 wherein said means for raising said in-line idler rollers includes an adjustment knob having a detent section spring load against one of said idler shafts, said detent section including eccentric and flat detents, said center plate section being displaced longitudinally along said third direction when said adjustment knob is rotated from one of said eccentric and flat detents to the other, said arms pivoting about said idler shafts with the displacement of said center plate.

5. The apparatus of claim 1 wherein said guide means includes a flat spring curved at one end and fastened to a downstream end of one of said end plates over a side of said third direction paper path adjacent to said second direction transporting means, the other end of said flat spring being secured to deck outside the other side of said third direction paper path.

6. The apparatus of claim 5 wherein said flat spring extends transversely over the paper path at a 45° angle.

7. The apparatus of claim 6 wherein said guide means further includes a flat spring mounted to said end plate and extending in said third direction.

* * * * *